United States Patent [19]

Bouteille

[11] 4,356,760

[45] Nov. 2, 1982

[54] RAM LOCKING DEVICE

[75] Inventor: Daniel Bouteille, Ville D'Avray, France

[73] Assignee: La Telemecanique Electrique, France

[21] Appl. No.: 142,184

[22] Filed: Apr. 21, 1980

[30] Foreign Application Priority Data

Apr. 27, 1979 [FR] France ..... 79 10796

[51] Int. Cl.[3] ..... F15B 13/042

[52] U.S. Cl. ..... 91/445; 92/163; 137/615; 251/63

[58] Field of Search ..... 91/445, 418, 420, 447, 91/461; 92/119, 163; 137/615, 580; 251/63

[56] References Cited

U.S. PATENT DOCUMENTS

| | | | |
|---|---|---|---|
| 2,509,880 | 5/1950 | Pelton | 251/63 X |
| 2,705,020 | 3/1955 | Frantz | 251/63 X |
| 2,905,432 | 9/1959 | Mercier | 251/63 |
| 3,323,546 | 6/1967 | Lord | 137/615 |
| 3,712,179 | 1/1973 | Hanson | 91/445 X |
| 3,828,652 | 8/1974 | Beneteau | 91/445 |

FOREIGN PATENT DOCUMENTS 1119615 12/1961 Fed. Rep. of Germany .

*Primary Examiner*—Irwin C. Cohen
*Attorney, Agent, or Firm*—William A. Drucker

[57] ABSTRACT

A locking device is integrated in a coupling fixed on a ram cylinder for feeding the cylinder with a first fluid. The circulation of that fluid is controlled by a second fluid. The device has (1) a cylindrical member with a tightening head at a first end, a second threaded end to engage in the cylinder, and an intermediate portion between the two ends. The intermediate portion has an axial outlet passage to the cylinder, and a lateral opening terminating at the passage. The device has a coupling head with a through bore, and an internal passage for the first fluid. The bore is shaped to receive the intermediate portion and to couple the opening to the feed passage. The device has movable internal members to modify circulation of the first fluid by moving under the combined effects of a resilient element and the pressure of a second fluid applied to an external locking inlet. The improvement is that the movable members (42, 70) are disposed in the axis XX' of the cylindrical element (4) in a region thereof extending from the intermediate portion (20) to the tightening head (15), the latter receiving the locking inlet (13).

1 Claim, 7 Drawing Figures

RAM LOCKING DEVICE

BACKGROUND OF THE INVENTION

The invention relates to a locking device integrated in a coupling fixed directly onto a ram cylinder for the feeding of the cylinder with a first fluid the circulation of which is controlled by a second fluid, the device comprising (i) a cylindrical member provided with a tightening head at a first end, and with a second threaded end adapted to be engaged into the cylinder, and with an intermediate portion comprised between the first and second ends which is provided with an axial outlet passage towards the cylinder and with a lateral opening terminating at said outlet passage, (ii) a coupling head having a first bore which passes through it, and an internal feed passage through which the first fluid flows, this bore being shaped to receive the intermediate portion and to couple said opening to said feed passage, and (iii) movable internal members intended to modify the circulation of the first fluid by moving under the combined effects of resilient means and a pressure of the second fluid applied to an external locking inlet of the device.

Such devices are used in particular when the pistons or rams, submitted to a permanent loading, must be halted and kept in a predetermined position.

THE PRIOR ART

Such a locking means is illustrated in German Patent application No. 1119615 wherein the dimensions of the hydraulic locking device are large, having regard to the simplicity of the function to be fulfilled; furthermore, the device described is intended to produce, in normal operation, a slowing of the speed of one of the strokes of the ram, and to lock the ram solely in the case of rupture of a pipe; finally the apparatus illustrated comprises movable members which are disposed in one of the elements of the device which is the least easy to work on.

OBJECT OF THE INVENTION

The invention proposes principally to remedy the inconveniences mentioned hereinabove. Further features provide a locking device adapted to be used advantageously with pneumatic rams wherein the conditions of operation and of use are not the same as in installations with hydraulic control.

SUMMARY OF THE INVENTION

According to the invention movable members (respectively 42 and 70) are disposed on the axis XX' of the cylindrical element 4 in a region extending from the intermediate portion 20 to the tightening head 15, this latter receiving the locking inlet 13.

There are already known coupling devices, with an orientatable head, for pneumatic rams, which are threaded directly into the latter and which comprise means having a particular function of control in view of the fluids which flow through them, such as a function of reduction of outflow whch may be unidirectional. The simplicity of the elements used to carry out these functions is such that their incorporation in the small space existing between the orientatable couplings currently available on the market does not pose any problem other than that of assuring for them a good reliability and of diminishing their cost of manufacture. It is another entirely when the functions to be carried out necessitate the putting to work, in a small space, of movable members, resilient means and devices which must be totally fluid tight, whilst nevertheless keeping to the requirements inherent to the different levels of pressure, notably of their threshold, which these functions call for in order to utilise direct or inverse logic signals.

BRIEF DESCRIPTION OF THE DRAWINGS

The invention will be better understood from the following description of several methods of construction, all calling for common features, and which is illustrated by the accompanying drawings.

In the drawings:

FIGS. 2, 4, 6 and 7, which use rotatable couplings of a model different from those which are used in FIGS. 3 and 5, show that these rotatable couplings intended to transport the locking signals are associated in a manner analogous to tightening heads of similar shapes.

DESCRIPTION OF THE PREFERRED EMBODIMENT

Figure 1:
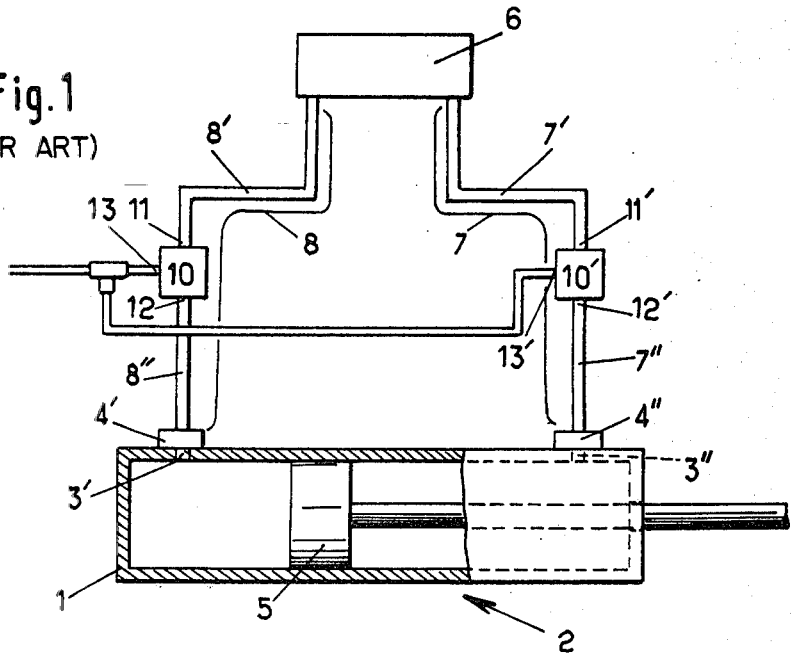
Fig. 1 (PRIOR ART)
FIG. 1 shows schematically the circuits and components used in the prior art.

The body 1 of a ram 2 visible in FIG. 1 is provided at its ends with threaded openings 3',3" which respectively receive a coupling 4',4" intended respectively for the transfer of the feed fluid and for the exhausting of this fluid, this transfer and exhaust resulting from movements imposed on the piston 5 of the ram by a distributor, such as is shown schematically at 6, which is connected to the ram by conduits 7 and 8.

When the piston of the ram is to be locked in a certain position, and above all if this piston is under loading, it is necessary to interrupt not only the feed of fluid terminating at one side of the piston, but likewise to prevent the fluid present at the other side of the piston from returning towards exhaust.

For this purpose, there has already been a proposal to place in series in the two conduits 7 and 8 a locking means 10',10 (such as the locking means called 2/2) which each play the part of a valve interrupting, with the aid of pneumatic switching members, the circulation of a fluid between a respective distribution inlet 11, 11' of a locking means, and a respective outlet 12, 12', this valve being controlled by pneumatic means with the aid of signals applied to a respective locking input 13, 13'.

As these signals are generally obtained from pilot circuits providing pneumatic locking instructions applying to a particular logic, using appropriate circuits, it is necessary that a pneumatic isolation exists between the locking inlet, on the one hand, and the distribution inlet and the outlet on the other hand.

These locking means can, as a function of the particular needs and of the logic locking signals, authorize the passage of a fluid either when a pressure signal is applied at inputs 13 or 13', or again in the absence of such a signal.

When the control installations are remote from the rams, the volumes of air included in the portions of conduits 7',7" and 8',8" placed upstream and downstream of the locking means become large with respect to the volume of the ram itself, and it is thus desirable to place the locking means in the vicinity of the ram in order to avoid any parasitic resilience of the fluid.

Figure 2:
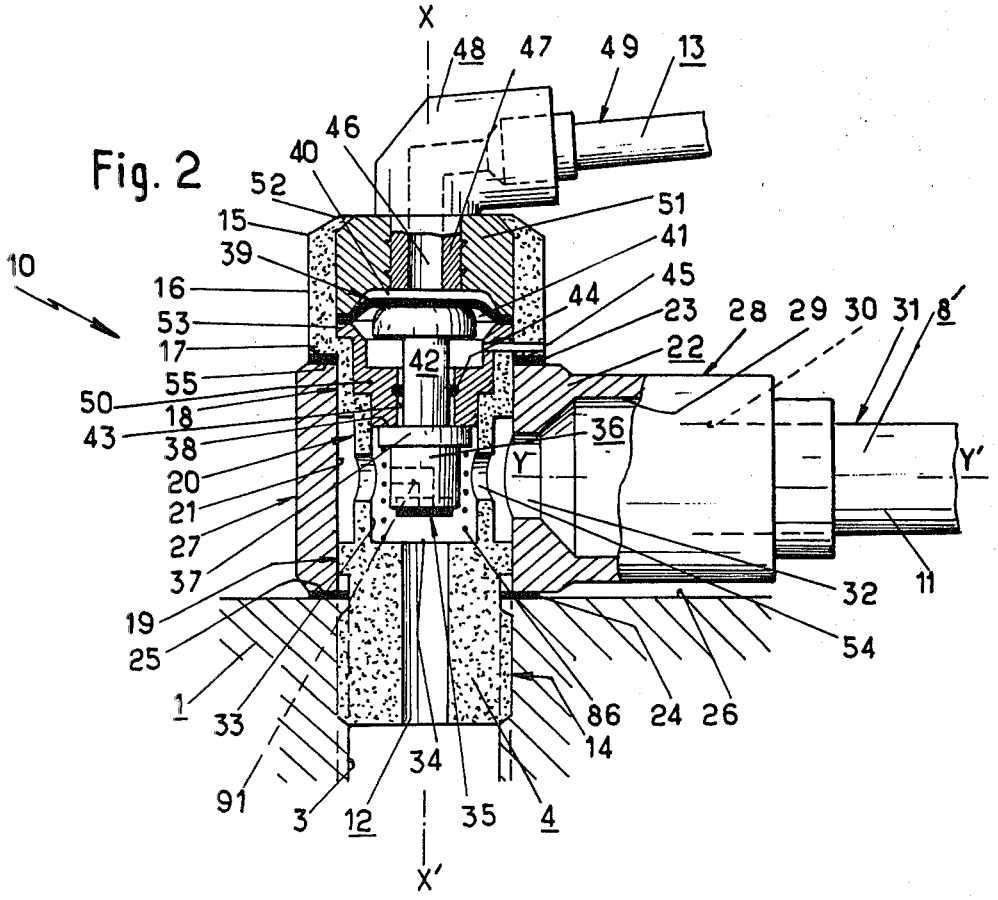
FIGS. 2, 3 and 7 show variations of construction using membranes and valves for carrying out the closing.

The devices illustrated in FIGS. 2 to 7 show various modifications of the invention, and reference is first made to FIG. 2 wherein the elements having the same functions carry the same reference numerals. The apparatus shown here is a locking device carrying out the function of that shown at 10 or 10' on FIG. 1. A fixing element 4 of generally cylindrical shape serving as the coupling 4 and as the portion of conduit 8'' of FIG. 1, comprises a threaded end 14 traversed by an axial opening 12, this latter representing the outlet of FIG. 1. A second end of this element 4 has a tightening head 15 carrying, for example on its external surface, flats such as 16 permitting an appropriate tool to impart to it a rotation when the end 14 is engaged in the threaded opening 3, of the ram 1, through which its control is effected.

Between the two ends of the element 4 are disposed cylindrical surfaces 18 and 19 and a recess 20 all concentric with an axis of revolution XX' of the element 4, a radial shoulder 17 separating the head 15 from the surface 18.

This element 4, which passes through a bore 21 formed in a head 27 of a second element 22, permits the fixing of this latter in a fluid-tight manner on the ram, by reason of the seals 23 and 24 disposed respectively between the shoulder 17 and a plane annular surface 55 bounding the bore 21, and between an annular surface 25 of this same element 22 likewise bounding the bore and a surface 26 of the ram. By reason of the co-operation of the surfaces 21, 18 and 19, the element 22 can assume any angular orientation about the axis XX', both in the course of assembly in order to give it a desired position of rotation, and likewise after assembly if the tightening and the nature of the seals 23 and 24 are adapted to such a need.

The external surface of the element 22 has a cylindrical extension 28 with an axis YY' which is substantially directed towards the axis XX' and makes with this latter an angle preferably of 90° in order that the extension may be placed parallel to the axis of the ram; this extension comprises a bore 29 intended to receive members (not shown) suitable to receive and retain in a fluid-tight manner an end 30 of a tube 31 representing the conduit portion 8' of FIG. 1. This bore 29 is coupled to the first bore 21 through an opening 32 and represents the distribution inlet 11 of FIG. 1.

The interior of the fixing element 4 receives closing members in a chamber 33 connected to the outlet passage 12 through an opening 34 opposite to which is placed a valve element 35 made of an elastomer appropriate to its function.

This valve element is carried by a body of revolution 36 which is movable, parallel to XX', between a first rest position in which a collar 37 which it carries abuts against an internal shoulder 38 under the effect of a compression spring 86, and a second working position in which the valve element 35 closes the opening 34.

The movements of the body 36 are originated by those which are undergone by a diaphragm 39 placed at the interior of the tightening head.

This diaphragm isolates pneumatically a first space 40 situated above it from a second space 41 placed below it and receiving a push rod 42 forming part of the body 36 or coupled to the latter. This rod 42 is guided at the interior of the element 4 by a fixed cylindrical surface 43, a seal 44 being disposed between the rod 42 and this guiding surface.

A vent hole 45 coupling the second space 41 to the exterior permits the diaphragm to be deformed towards the base of the figure when the locking pressure appears in a passage 46 communicating with the first space, and to be deformed upwardly when this pressure has disappeared, the return force of the spring pushing back the push rod; furthermore, any flow if air arising from the placing under pressure of the tube 31 and which would end up in the chamber 41 would be evacuated through this vent hole.

The passage 46 is at the interior of a tubular portion 47 parallel to axis XX' and engaged in the tightening head and forming part of an orientatable coupling 48 into which the re-enters laterally the end 49 of a pipe representing the locking inlet 13; this coupling can pivot by reason of the fact that the tubular portion 47 has ribs assuring the maintenance of axial positioning and permitting rotation without escape of fluid.

The valving means 35, 36, 37, 39, 42 and 86 are advantageously disposed about the same axis of symmetry XX', and to permit an easier mounting thereof, the surface 43 is advantageously formed at the interior of a skirt 50 provided in the element 4, while a stopper 51 secured at 52 in the interior of the tightening head, receives the tubular portion 47 and pinches the periphery of the membrane in fluid-tight manner against an annular surface 53 of the skirt. Finally, openings 54 connecting the chamber 33 to the recess 20 permit the fluid to circulate from the bore 29 to the outlet channel 12 or inversely, when, in the absence of a locking signal at 46, the valve is open.

On the other hand, by reason of the ratio existing between the diameter of the membrane and that of the push rod, the appearance of a locking pressure signal at passage 46 permits to overcome the forces created by the feed pressure and by the return spring, in order to cause the closing of the opening 34 and thus prevent any movement of fluid through this opening.

The tubes 31 and 49 may be flexible or deformable or rigid.

Figure 3:
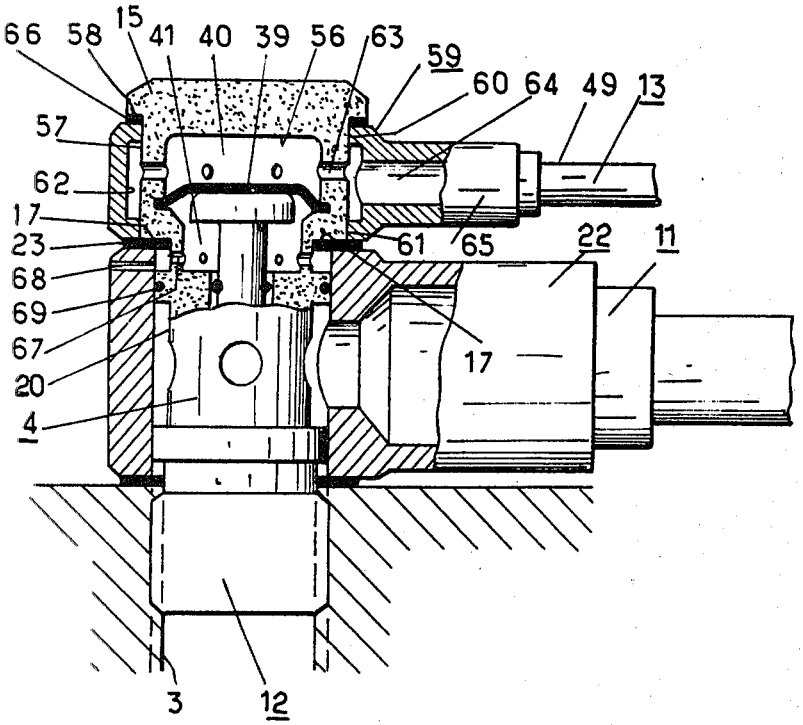

In the manner of construction illustrated in FIG. 3, wherein the elements having the same functions as described precedingly have the same reference numerals, the tightening head 15 likewise receives a diaphragm 39 in a chamber 56 of this head.

A third cylindrical surface 57 advantageously centered on axis XX' here separates the shoulder 17 from a second annular shoulder 58 placed above it.

A third element 59, analogous to the second element 22, has two portions of bore 60, 61 which are separated by an annular recess 62 of greater diameter and which are in contact with the third cylindrical surface 57 in order to permit the element 59 to assume any angular orientation with respect to the axis XX'.

The upper space 40 is connected to the recess 62 by openings 63 of the head terminating at the surface 57, this recess being itself coupled by the channel 64 to an end 49 of a tube engaged in the lateral extension 65 of the element 59 and representing the locking inlet 13.

This third element is disposed between two seals 23 and 66 placed axially one at each side of the ends of the bore portions 61, 61, these seals being pressed against the second element 22, and against the shoulder 58 when the element 4 is screwed into the threaded opening 3.

Vent holes 67, 68 passing successively through the element 4 and the head 27 of the element 22 permit the connection to the exterior of the space 41, a supplementary seal 69 being disposed between these vent holes and the recess 20.

The thickness of the seals 23 and 66, as well as the height of the cylindrical portion 57 are preferably selected to permit the rotation of the element 59 when the element 4 is tightened; the third element 59 can also act as a rotatable coupling to the assembly.

Figure 4:
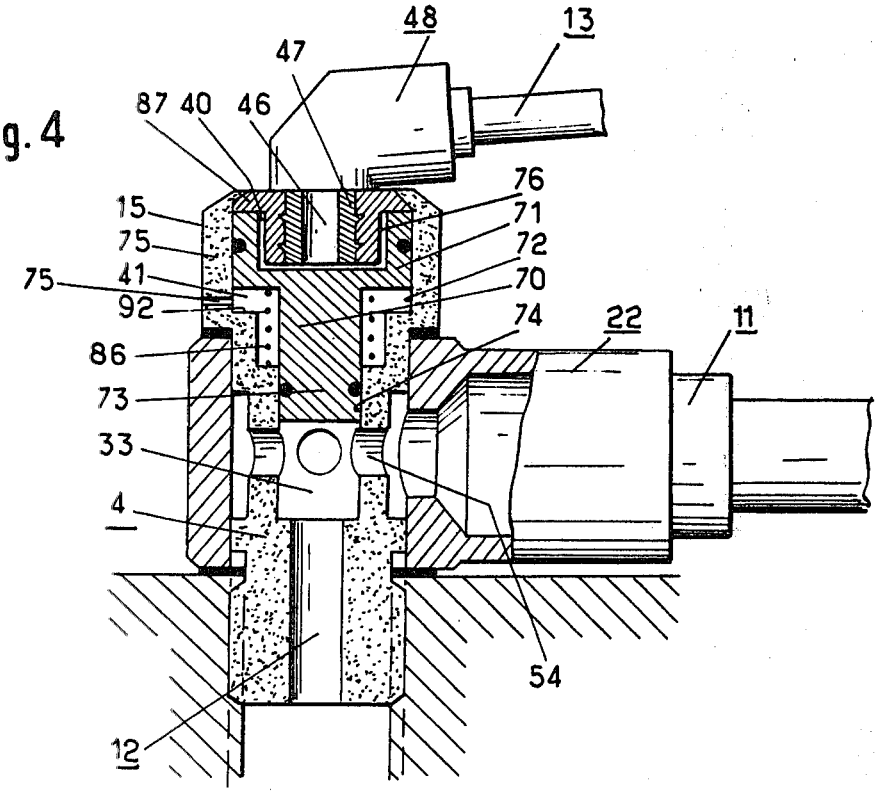
FIGS. 4, 5 and 6 show variations of construction using slides to carry out the closing.

In the manner of construction seen in FIG. 4, the closing members are shown by a slide 70 sliding in the element 4 along the axis XX'. This slide comprises here an upper piston 71 movable in fluid-tight manner in a bore 72 disposed in the tightening head 15, and a closure 73 fitted within a chamber 74 of the element 4 which is comparable to that of FIG. 2.

A return spring 86 is placed in the chamber 41 disposed under the piston, and the chamber 42 situated above the piston is connected to the channel 46 of a rotatable coupling 48 as in FIG. 2. Here again, the space 41 is connected to the exterior through the vent hole 75, and the locking is obtained in this instance by the closing of the opening 54 when, in the presence of a pressure signal applied at passage 46, the piston descends and compresses the spring.

To give the piston a sufficient stroke without increasing the height of the head 15, this latter has a cyindrical recess 76 surrounding the portion 47 of the rotatable coupling 48 fixed in a stopper 87 which closes the bore 72 at the external part of the head 15.

Figure 5:
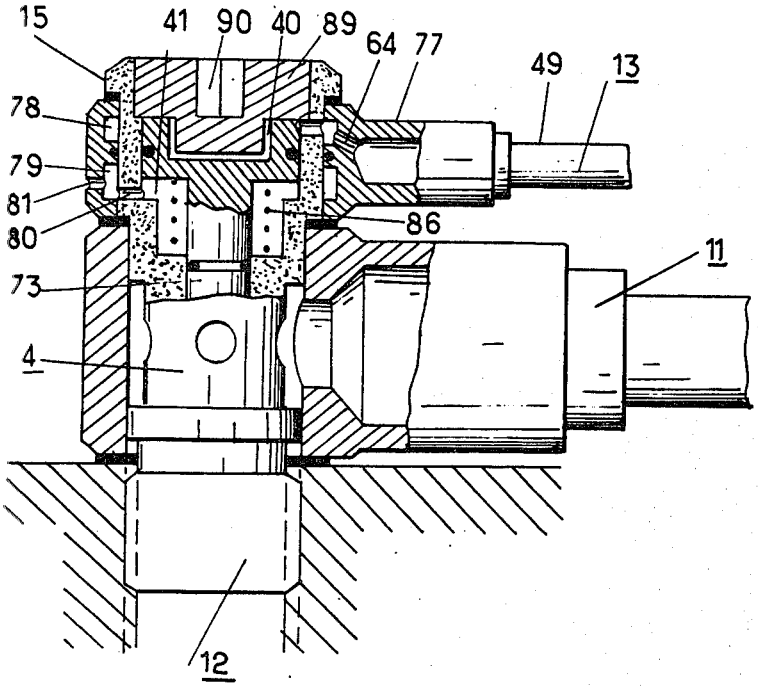

The manner of construction of FIG. 4, in which the closing means require a slide, can likewise be provided with a rotatable coupling 77 comparable with that of FIG. 3, and shown in FIG. 5; it would be possible, as a modification of the construction of the element 59, to dispose in the head two annular recesses 78, 79 isolated one from the other in the channel coupling 77 in order to connect the channel 64 and the space 40, and to couple the space 41 to the exterior through the vent holes 80, 81 of the element 4 and of the coupling 77. A stopper 89 engaged in the head 15 can have a recess 90 with six flats to permit use of a tightening tool.

Figure 6:
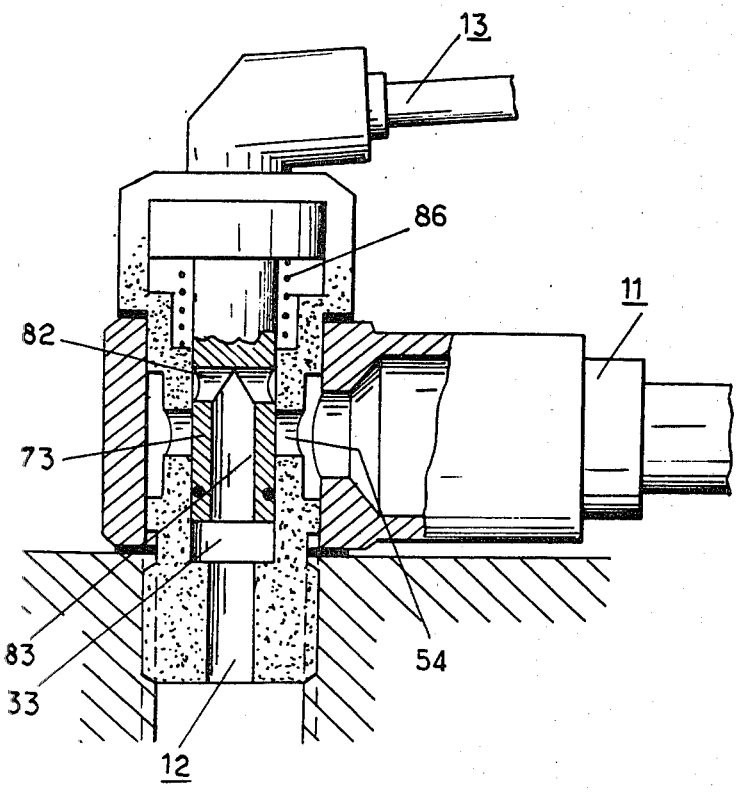

Finally, a manner of construction in which the valving means permit a transfer of fluid between the distribution inlet 11 and the outlet 12 when the locking pressure is applied at 13, is shown by way of example in FIG. 6, wherein a closure 73 comparable to that of FIG. 4 comprises a diametral passage 82 which is connected to an internal passage 83 opening into the chamber 33 and communicating with the outlet 12, and which is also placed opposite to openings 54 when the piston is in its working position in which the spring 86 is compressed.

A valve and a diaphragm, such as those shown in FIG. 2, can likewise be arranged to permit the transfer of fluid with the aid of a closing member 36 when the locking pressure is applied at 13.

Figure 7:
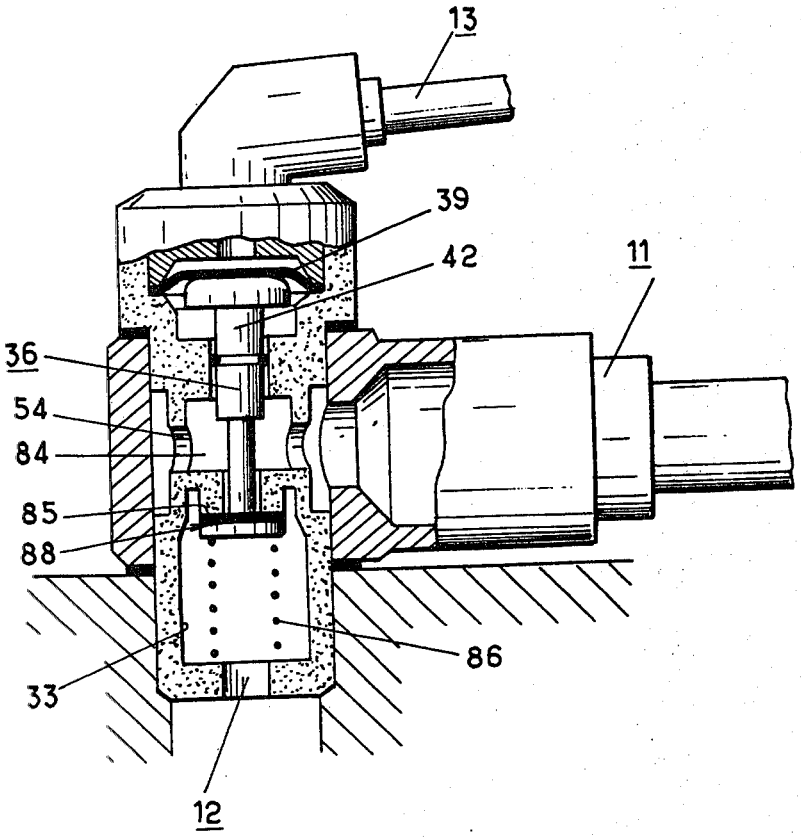

FIG. 7 illustrates this manner of construction wherein the openings 54 now open into a chamber 84, of the element 4, which is connected to the chamber 33 through an opening 85. The valve element 88, carried by the push rod 42 and movable in the chamber 33, closes this opening under the effect of a return spring 86 and, consequently, opens this opening when a locking pressure signal applied at 13 causes a deformation of the diaphragm 39 towards the base of the figure.

The locking means described above utilise valves or slides which cause total closures and total openings of the fluid passage openings.

In certain applications in which it is desired to interrupt a movement as high speed of a ram in order then to give it a displacement at slow speed, it is necessary to permit the occurrence of a reduced flow of fluid after the reception of a locking command.

Such a flow can be produced, for example, with the aid of a passage 91 of appropriate section which is disposed in the body 36, see FIG. 2, in such a manner as to place in communication the outlet 12 and the chamber 33 when the valve element 35 is pressed onto the opening 34. Another arrangement to create such a reduced flow consists is not permitting the slide 70,73 to close fully the orifices such as 54 seen in FIG. 4, when the pressure is applied at 13, for example by causing the piston to abut on a radial surface 92 of the chamber in which it moves.

I claim:

1. In combination: a ram cylinder; a source of high pressure fluid; an inlet and exhaust distributor; a source of control pressure fluid; a coupling and locking device having a supply inlet connected to the source of control pressure fluid and an outlet, said ram cylinder having a cylinder side surface portion and a threaded opening in said cylinder side surface portion, said coupling and locking device comprising:

(i) a generally cylindrical body having a threaded end, and, at the opposite end thereof, a tightening head adapted for controlling the screwing engagement of the said threaded end into the said threaded opening, said cylindrical body further having, located between the threaded end and the tightening head, an intermediate body portion having an inner axial channel terminating into an outlet aperture at said threaded end and forming the said outlet, and a transverse channel opening into a lateral opening in the outer surface of the said intermediate body portion, said tightening head having an inner housing having first and second housing portions;

(ii) a fluid control member mounted movable within said inner housing and sealingly separating the said first and second housing portions from each other;

(iii) orientatable coupling means mounted on said tightening head and having a first end portion which forms said control inlet and a second end portion which opens into said first housing portion;

(iv) valve means mounted movable within said inner axial channel and coupled to said fluid control member for actuation by said fluid control member, said valve means having a first position in which the fluid communication between the said lateral opening and the said outlet aperture is established and a second position in which the said communication is closed;

(v) spring means, cooperating with the said valve means to move the said valve means into a direction opposite to direction of motion of said valve means under actuation by said fluid control member;

(vi) a pivoting coupling means having a collar-shaped body portion and a generally tubular transverse extension, said collar-shaped body portion having first and second transverse parallel faces and an inner axial bore which receives and encloses the said intermediate body portion of said generally cylindrical body, said generally tubular extension having a passage therein which forms the said supply inlet and opens into said inner axial bore, said first transverse face of the collar-shaped body portion sealingly engaging the said tightening head and the said second transverse face of the collar-shaped body portion sealingly engaging the said cylinder side surface portion.

* * * * *